US008469258B2

(12) United States Patent
Timbrook et al.

(10) Patent No.: US 8,469,258 B2
(45) **Date of Patent: *Jun. 25, 2013**

(54) REINFORCED CROSS-LAMINATED BULK CONTAINER

(75) Inventors: Ronald D. Timbrook, Edgerton, OH (US); Ryan M. Myers, Auburn, IN (US); William F. Moss, Canonsburg, PA (US); Marty Patrickus, Hazelhurst, WI (US)

(73) Assignee: International Paper Company, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/309,886

(22) Filed: Dec. 2, 2011

(65) Prior Publication Data

US 2012/0104083 A1 May 3, 2012

Related U.S. Application Data

(63) Continuation-in-part of application No. 12/755,887, filed on Apr. 7, 2010.

(51) Int. Cl.
*B65D 5/50* (2006.01)

(52) U.S. Cl.
USPC ..... 229/122.32; 229/155; 229/157; 229/199; 229/939

(58) Field of Classification Search
USPC ..... 229/122.32, 122.33, 155–157, 199, 229/939; 206/386, 600
See application file for complete search history.

(56) References Cited

U.S. PATENT DOCUMENTS

| | | | | | |
|---|---|---|---|---|---|
| 1,527,021 | A | * | 2/1925 | Wandel | 229/199 |
| 1,809,953 | A | * | 6/1931 | Witte | 229/939 |
| 3,063,615 | A | * | 11/1962 | Bronte et al. | 229/122.32 |
| 3,185,045 | A | | 5/1965 | Bronte et al. | |
| 3,873,017 | A | * | 3/1975 | Blatt | 229/122.33 |
| 4,398,650 | A | * | 8/1983 | Holmes et al. | 229/939 |
| 4,585,143 | A | | 4/1986 | Fremow et al. | |
| 4,693,413 | A | | 9/1987 | McFarland et al. | |
| 4,702,408 | A | * | 10/1987 | Powlenko | 229/199 |
| 4,793,550 | A | * | 12/1988 | Gottlieb | 229/199 |
| 4,964,561 | A | | 10/1990 | Whelan | |
| 5,046,662 | A | * | 9/1991 | Cowles | 229/157 |

(Continued)

FOREIGN PATENT DOCUMENTS

| | | |
|---|---|---|
| DE | 29721079 | 3/1998 |
| FR | 1578148 | 8/1969 |
| FR | 2403271 | 4/1979 |
| FR | 2677609 | 12/1992 |

*Primary Examiner* — Gary Elkins
(74) *Attorney, Agent, or Firm* — Matthew M. Eslami

(57) ABSTRACT

A reinforced cross laminated corrugated paperboard bulk container has an outer component and an inner liner laminated to the outer component with the liner having corrugations extending perpendicular to the corrugations in the outer component. The bottom edges of the sidewalls include a first pair of flaps and a second pair of flaps each of which foldably extend outwardly therefrom and wherein each of the second pair of flaps having a pair of spaced apart triangularly shaped slots formed therein and wherein each of the first pair of flaps includes a pair of locking tabs formed on opposed end of the respective first pair of flaps which are engaged with the slots on the second pair of the flaps to securely close the bottom of the container. Vertical scores in the liner are pre-broken prior to laminating it to the outer component.

5 Claims, 11 Drawing Sheets

U.S. PATENT DOCUMENTS

| | | | | |
|---|---|---|---|---|
| 5,104,035 | A * | 4/1992 | Rosenbaum, II | 229/157 |
| 5,351,849 | A * | 10/1994 | Jagenburg et al. | 229/122.33 |
| 5,772,108 | A * | 6/1998 | Ruggiere et al. | 229/199 |
| 6,076,730 | A | 6/2000 | Boutin et al. | |
| 6,076,734 | A | 6/2000 | Dougherty et al. | |
| 6,293,460 | B1 * | 9/2001 | Boutin et al. | 229/157 |
| 7,172,108 | B2 | 2/2007 | Ingalls | |
| 2002/0096559 | A1 | 7/2002 | Quaintance | |
| 2003/0132275 | A1 | 7/2003 | Ingalls | |
| 2006/0163333 | A1 | 7/2006 | Kornacki | |
| 2006/0169757 | A1 * | 8/2006 | McDowell | 229/122.33 |
| 2007/0257094 | A1 * | 11/2007 | Jackson et al. | 229/199 |
| 2010/0230480 | A1 | 9/2010 | Southwell et al. | |
| 2011/0248080 | A1 | 10/2011 | Timbrook et al. | |

* cited by examiner

REINFORCED CROSS-LAMINATED BULK CONTAINER

CROSS REFERENCE TO RELATED APPLICATIONS

This continuation-in part application claims priority to U.S. non-provisional patent application Ser. No. 12/755,887, filed on Apr. 4, 2010, which is hereby incorporated hereinto by reference as if fully restated herein.

FIELD OF THE INVENTION

This invention relates generally to bulk shipping and storage containers. More particularly, the invention relates to a bulk container made of reinforced cross-laminated corrugated paperboard. In a preferred embodiment the container has interlocking full bottom flaps and is especially adapted for containing fluid products.

BACKGROUND OF THE INVENTION

In the bulk handling of materials, and especially fluid or flowable materials such as liquids, powders and granules, containers of 20 to 80 gallon capacity are commonly used to transport and store the material. These containers should be capable of withstanding the weight of the contents and of being stacked on top of one another. They should also be capable of withstanding the rough handling to which they may be subjected, and be capable of being handled with mechanized equipment.

A variety of containers have been developed in the prior art in an effort to meet these criteria, including drums made of metal or fibre, plywood bins, and corrugated paperboard containers. While plywood bins and drums made out of metal or fibre possess the requisite strength and durability, they are expensive to manufacture, store and ship.

Corrugated paperboard containers are less costly to make and generally can be collapsed for compact storage and shipment. However, when filled with a fluid product the sidewalls of the container may bulge outwardly, and depending upon the size of the container and weight of the material used in its construction it may be difficult to set up. Further, a flexible bag liner is commonly used when a fluid material is to be contained, and unless special consideration is given to how the container is constructed, the liner may be damaged by elements of the container protruding into the interior of the container.

Bulk containers may be palletized for ease and convenience of handling, and it is desirable that the container or containers efficiently fit the pallet, i.e. that they do not overhang the edges of the pallet, or the edges of the pallet do not extend an excessive distance beyond the perimeter of the container or containers supported thereon. Pallets typically utilized are 40×48 or 44×44 or 44×54 inches in size and are square or rectangular in shape. Cylindrical drums do not efficiently fit a pallet because the circular footprint of the drum leaves void spaces between adjacent drums and at the corners of the pallet. Conventionally constructed square or rectangular containers of corrugated paperboard can be sized to fit a pallet, but if the sidewalls bulge outwardly they can extend beyond the perimeter of the pallet and be subject to damage.

Conventional corrugated paperboard containers strong enough to hold fluid material are either difficult to set up from a flattened condition and/or are too hard to manufacture and/or are too expensive for the end-user. Bulging sidewalls and difficulty in setting them up from a knocked down or flattened condition are the major problems with conventional designs.

Therefore there is need for a bulk container made of corrugated paperboard that can take the place of a 20 to 80 gallon fibre drum or metal barrel, which can ship flat and be easily opened up for filling, and once it is empty, knocked down flat again for either re-use or recycling. Further, it would be desirable to have a container that can fit four on a pallet, that is reinforced against bulging of the sidewalls, and that maintains proper containment thereby eliminating potential contamination.

SUMMARY OF THE INVENTION

The present invention solves the foregoing problems through a combination of features, including cross lamination of a corrugated inner liner and an outer component, double score profiles on the 180 degree folds, use of re-enforcing tape such as Sesame Tape or a comparable re-enforcing strand in the liner and in the outer component, with the reinforcing tape extending perpendicular to the respective corrugations in the liner and in the outer component, and pre-breaking of the scores in the liner before lamination with the outer component. The cross lamination of the inner liner and outer component, together with the cross-hatch pattern created by the direction of the reinforcing tape or strands, fortifies the sidewalls against bulge and permits use of lower grades of material in the cross corrugation liner.

In a preferred embodiment of the invention the container is sized so that four of them can fit on a single pallet. Although the structural limit to a container is governed by the machines used to produce the corrugated fibreboard and the laminator with which the components are joined, the smaller size containers are difficult to fabricate so that they can be shipped in a knocked down condition and easily erected by the user. Pre-breaking the scores of the cross laminated inner liner before it is laminated to the outer component provides ease of fabrication and makes it easier for the end-user to open up the container from a knocked down condition. By pre-breaking the scores deeper definition is given to the body scores and the surface tension is reduced when the panels are folded to form the container. In accordance with the invention, an inner jig is employed during the folding operation at the point of closing the glue joints on the container. The jig helps to form a more uniform geometry by forcing the 180 degree fold ends into two 90 degree pairs of double score features at the vertical corners of the container.

The resistance to folding of bulk containers, especially the smaller sizes that are in high demand, is of paramount concern, and has been one of the major weaknesses of previous designs. Resistance to folding is created by the small panel sizes and the laminated construction. To overcome this resistance in the present invention, the scores in the inner liner are pre-broken before the liner is laminated to the outer component, and double scores are placed at the point of the 180 degree folds. The double scores lessen the surface tension on the outermost facing, and each of the double scores, individually, only has to fold 90 degrees in the container of the invention, together forming the 180 degree fold.

In a preferred embodiment the container of the invention has an interlocking bottom flap construction that minimizes the risk of failure during handling, and avoids pinching of a bag liner when a bag is used. The interlocking bottom flaps are designed to provide trouble-free continuous performance during handling even when liquids are stored in the container. The interlocking bottom flaps include a pair of opposed intermediate or inner flaps that provide a full overlap on the inside of the container bottom, with a smooth surface to prevent pinching a bag liner and causing a leak when a bag is used inside the container. Both intermediate flaps have perf scores (also known as cut and crease) just past the points of overlap of the intermediate flaps to assist the user in moving the flaps to their operative positions by preventing binding on the outer flaps which interlock. The interlocking structure of the outer flaps comprises a narrowed tab on the end edge of one outer flap, and a shaped slot adjacent the end edge of the opposing outer flap. The tab has rounded corners to allow entry into the opposing slot, and the shape of the slot inhibits bending of the tab during use. The outer flap that contains the slot also has angled perf scores to facilitate bending of this flap down into the container far enough to permit the tab to be engaged in the slot during set-up. Once engaged, the two interlocked flaps are pulled back up to create a stable flat surface on which the container rests during use. The shaped slot incorporates an arc so that the slot has a generally chevron shape, rather than the typical linear or rectangular geometry that is commonly seen in similar interlocks. Conventionally shaped slots apply force in a straight line across the tab when excessive force is exerted against it from product inside the container, causing the tab to bend. The chevron shape of the slot of the invention helps prevent bending of the tab by dispersing the excessive pressures in a non-linear pattern.

The liner can be any flute combination, such as C, B, A, AA, AC, BC, AB, AAA, ACA, CAA, CBA, etc, and combinations thereof. The outer half-slotted-container (HSC) of the invention also can comprise any of the same flute combinations. Selection of the flute combinations is governed by the desired performance level of containment and stacking strength.

The container of the invention can have any dimensions and any rectangular shape tailored to whatever a customer may want, being limited only by a manufacturer's ability to fabricate the container with the attributes of the invention disclosed herein.

Although the preferred construction has an interlocking, full overlapping bottom flap construction, it could comprise a set of partial flaps or flanges, if desired. A full bottom could also be constructed, but without the overlap that normally would be used in an application for liquid transport.

The preferred embodiment of container according to the invention has interlocking flanges at its upper end, but it could be constructed with no flaps or flanges at its upper end, or partial flaps without interlocking characteristics, or a full flap closure with or without any overlap. The preferred embodiment comprises interlocking flanges such as shown in U.S. Pat. No. 6,076,730, the disclosure of which is incorporated in full herein by reference. Interlocking top flanges in combination with the other features described earlier aids in the needed sidewall rigidity, and in turn helps prevent bulging and ensures proper product containment. Proper containment is necessary for secure storage and transport, whether the product is a food or an industrial ingredient.

Although the preferred embodiment has two reinforcing strands of tape (Sesame Tape or comparable types or brands) on the outer component and four strands on the cross laminated inner liner, the container of the invention could have any number of reinforcing strands, from no strands to eight strands per component, limited by the functionality for customer use and the manufacturer's ability to produce.

Further, a variety of flute configurations and combinations of the outer corrugated and the inner cross laminated corrugated could be used, such as singlewall (A-flute, B-flute, C-flute or any other flute size currently available) outer, and a cross laminated triplewall (AAA, ACA, CAA, CBA or any other flute combination currently available) inner. The inner cross corrugation could be any flute combination of double-wall and still provide adequate flexural rigidity which is needed for the practical use of the container.

Accordingly, one aspect of the present invention is directed to a reinforced cross laminated bulk container made of corrugated paperboard and having a rectangular configuration, the container comprises an outer corrugated component having opposed sidewalls joined together along vertical scores at corners of the container. The sidewalls have top, bottom and side edges, and the outer component having corrugations running in a first direction. The bottom edges of the sidewalls include a first pair of flaps and a second pair of flaps each of which foldably extend outwardly therefrom and wherein each of the second pair of flaps having a pair of spaced apart triangularly shaped slots formed therein. An inner corrugated liner is laminated to the outer component and having opposed sidewalls joined together along vertical scores at corners of the container. The sidewalls have top, bottom and side edges substantially coterminous with the top, bottom and side edges of the respective sidewalls of the outer component, and the inner liner have corrugations running in a second direction perpendicular to the first direction. the outer component and the inner liner each have at least one reinforcing strand therein extending perpendicular to the corrugations thereof, wherein the at least one reinforcing strand in the liner extends perpendicular to and crosses the at least one reinforcing strand in the outer component. Each of the first pair of flaps includes a pair of locking tabs formed on opposed end of the respective first pair of flaps which are engaged with the slots on the second pair of the flaps to securely close the bottom of the container.

Another aspect of the present invention is directed to a blank of corrugated paperboard for making a reinforced bulk container comprises an outer component having a plurality of sidewall panels and end wall panels foldably joined together along spaced parallel scores. The sidewall and end wall panels have top and bottom edges. The outer component having corrugations extending perpendicular to said top and bottom edges and at least one reinforcing strand extend across the outer component perpendicular to the corrugations and approximately midway between the top and bottom edges. The inner liner have a plurality of sidewall panels and end wall panels foldably joined together along spaced parallel scores is laminated to the outer component. The sidewall and end wall panels of the liner have top and bottom edges and the inner liner have corrugations extending parallel to the top and bottom edges thereof. At least one reinforcing strand extend across at least one said sidewall perpendicular to said corrugations and approximately midway between opposite side edges of said at least one said sidewall. The top flanges are foldably joined to the top edges of the sidewalls and end walls and top flanges have interlocking structure for locking them together in a container erected from said blank. The bottom flanges are foldably joined to the bottom edges of the sidewalls and end walls, the bottom flanges have interlocking structure for locking them together in a container erected from the blank.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
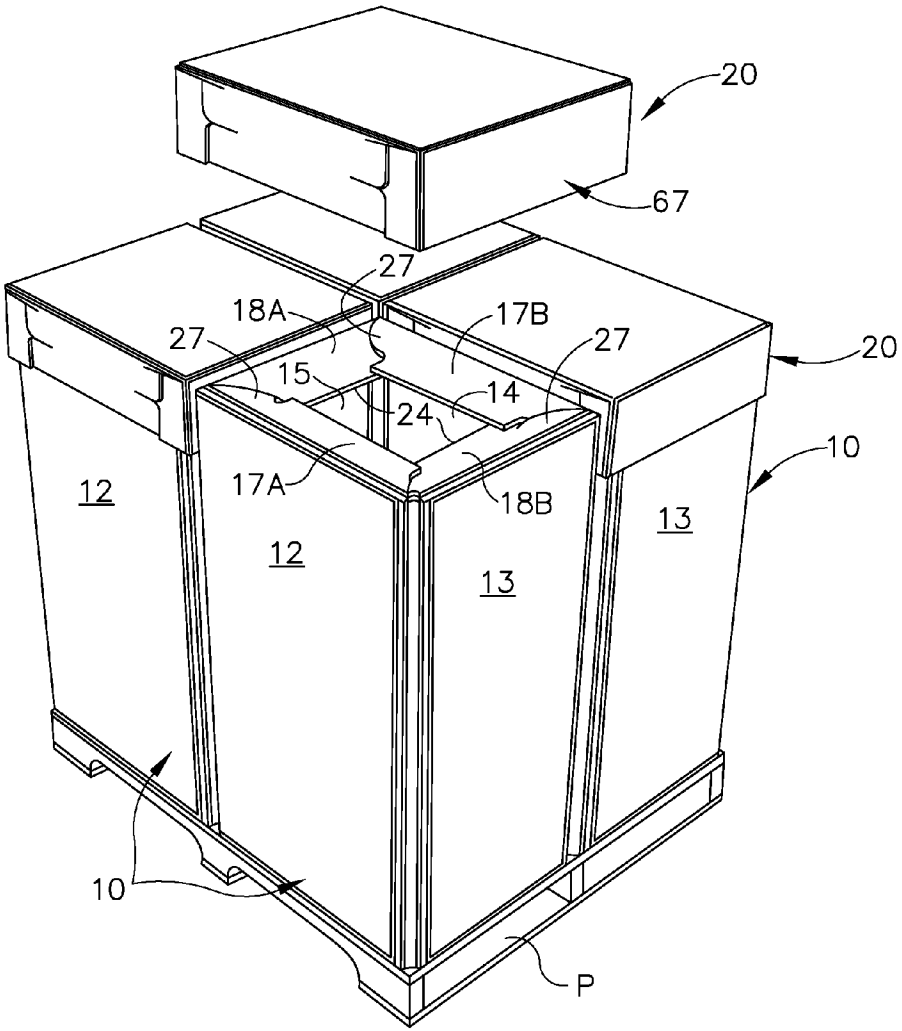
FIG. 1 is a partially exploded top perspective view of four containers according to the first embodiment of the invention resting on a pallet.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same or those elements are in the unfolded position.

A container made in accordance with a preferred embodiment of the invention is indicated generally at 10 in FIG. 1, wherein four of the containers are shown resting on a pallet P.

Figure 5:
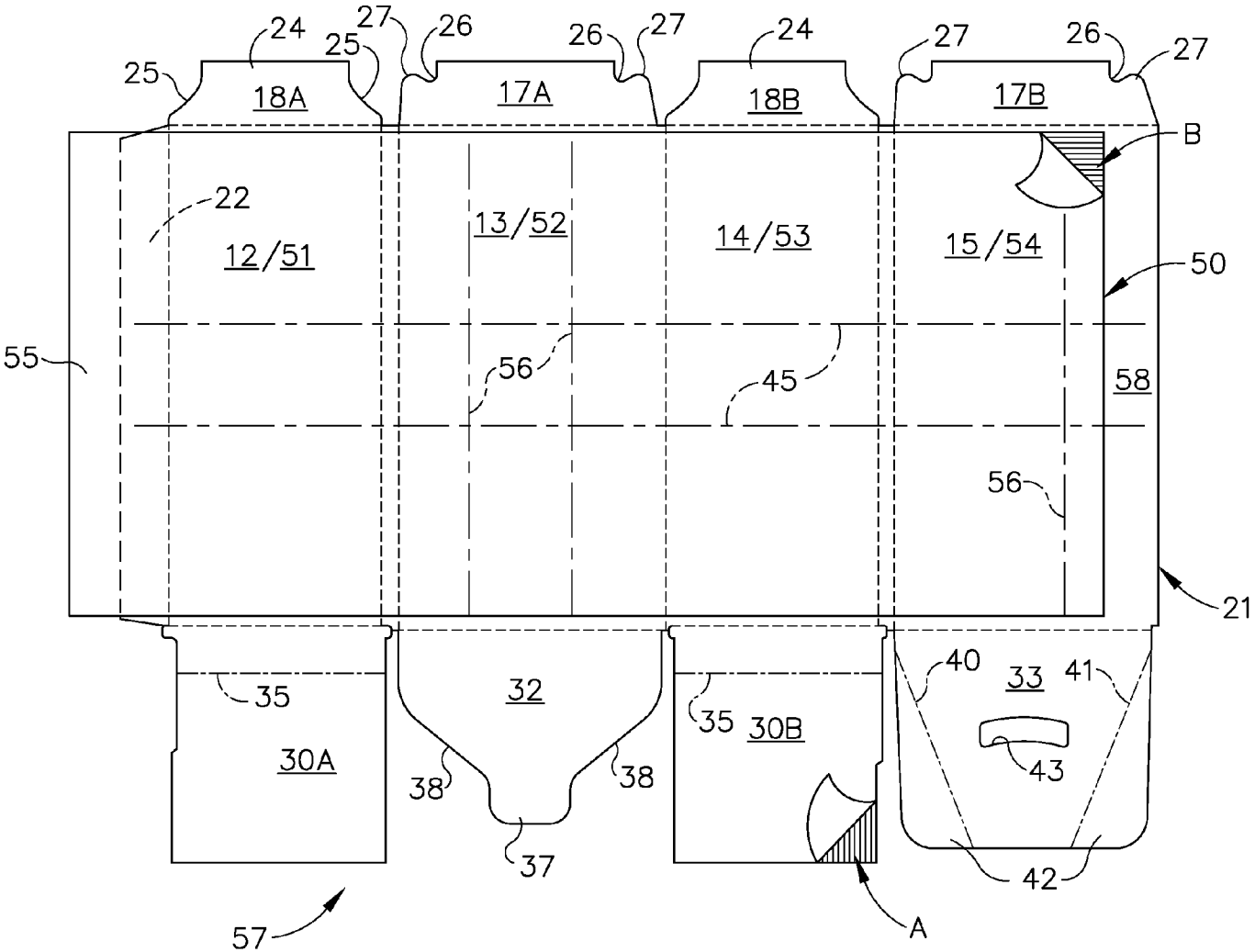
FIG. 5 is a top plan view showing the inner liner laminated to the outer component preparatory to folding the container and gluing the glue flaps together.
Figure 6:
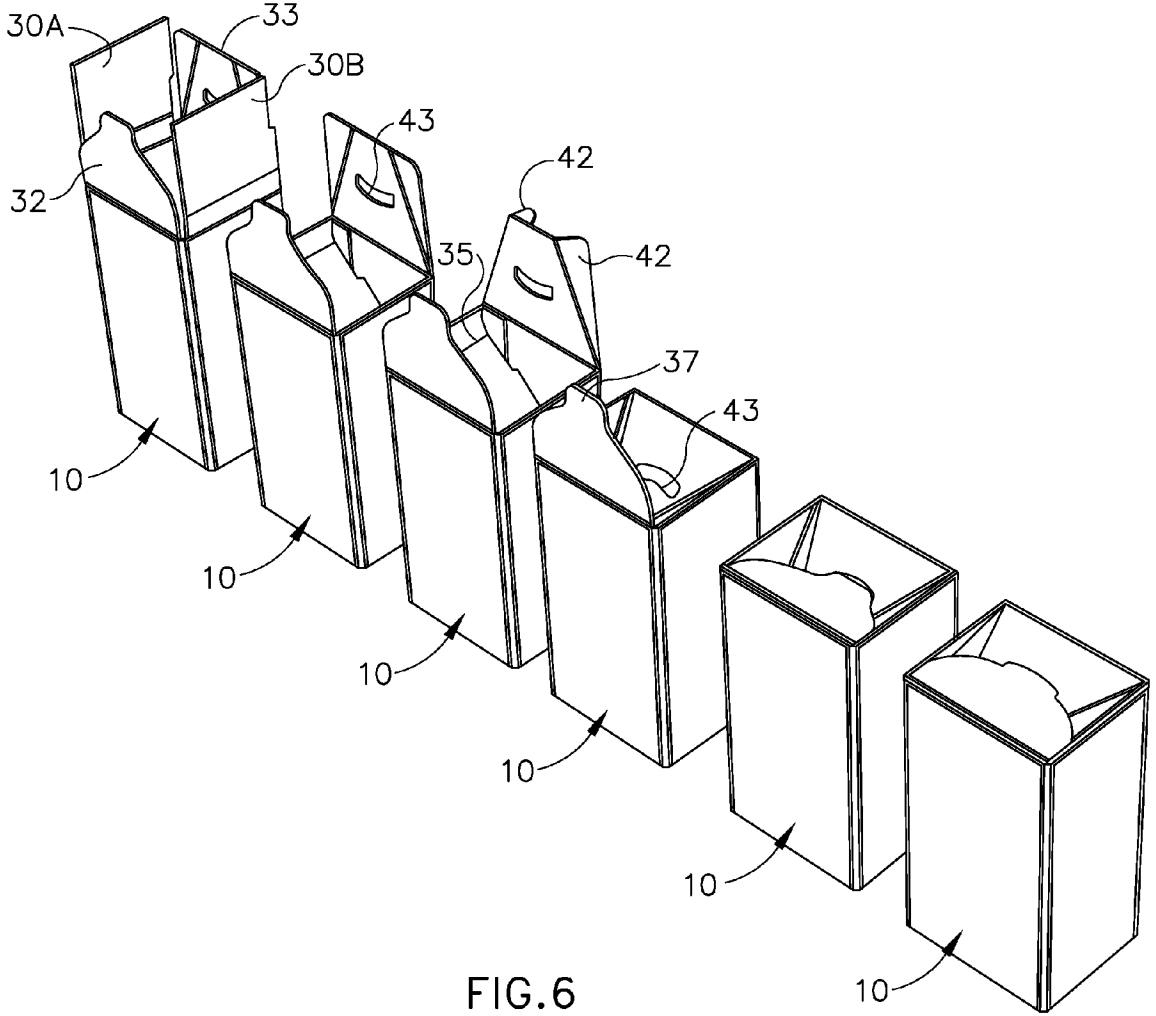
FIG. 6 shows the container in an inverted position and depicts the series of steps performed in folding the interlocking bottom flaps into operative interlocked position.

The container is rectangular in shape and has four sidewalls 12, 13, 14 and 15, joined together along vertical scores 16A, 16B, 16C and 16D at the corners, an open top end partially closed by interlocking top flanges 17A, 17B and 18A, 18B, and as seen best in FIG. 6 a closed bottom end 19. Two of the sidewalls 13, 15 have a greater width than the other two sidewalls 12, 14 which in turn can be considered end walls. A cap 20 is placed over the upper end of each container and in FIG. 1 is shown removed from one of them. Construction of the container is best understood with reference to FIGS. 2-6.

Figure 2:
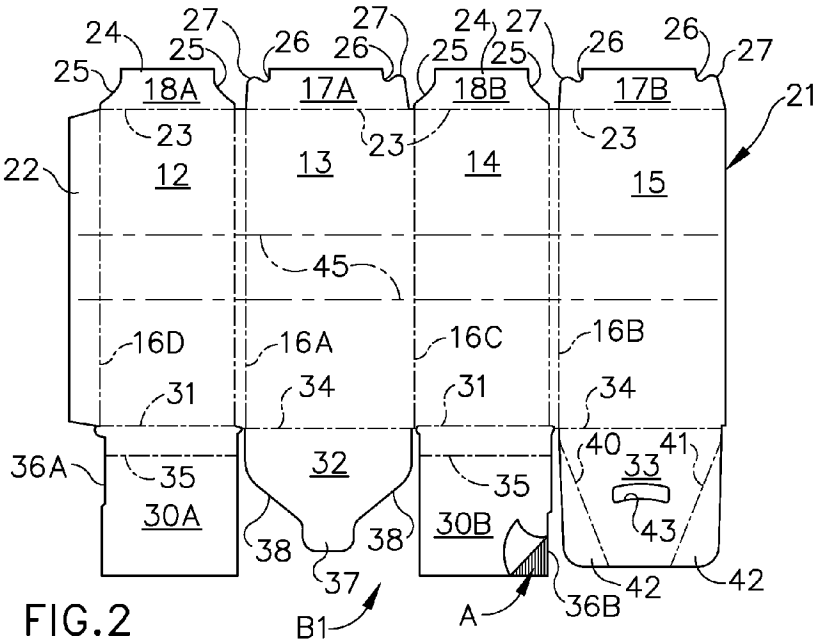
FIG. 2 is a top plan view of a blank for making the outer component of the container according to the first embodiment of the invention.

FIG. 2 shows a blank B1 for making the outer component 21 of the container. The blank comprises four sidewall panels 12, 13, 14 and 15 joined together along the respective scores 16A, 16B and 16C, with a glue flap 22 foldably joined to one end edge of the blank along fold 16D which effectively joins panel 12 to panel 15 when the container is glued up. The scores 16A and 16B are double scores as more fully described hereinafter and illustrated in applicant's prior U.S. Pat. No. 4,693,413, the disclosure of which is incorporated in full herein by reference. As described in that patent, the scores 16A and 16B extend along those corners joining sidewall panels that move through 180 degrees between the unfolded position of the blank and the folded flat position of a container made from the blank.

The partial top flanges 17A, 17B and 18A, 18B are foldably joined to top edges of the respective sidewall panels 13, 15, 12 and 14 along fold lines 23. The partial top flanges 17A, 17B and 18A, 18B are constructed substantially the same as and function in substantially the same way as described and shown in applicant's prior U.S. Pat. No. 6,076,730, the disclosure of which is incorporated in full herein by reference. Thus, opposite side edges of flanges 18A and 18B are cut away along curvilinear lines to define a locking tab 24 on the outer end edge thereof and rounded shoulders 25 on the opposite side edges. Flanges 17A and 17B have notches 26 cut in their outer end edges adjacent the opposite sides thereof, defining rounded corners 27 on opposite side edges of the flanges. As seen best in FIG. 1, when the flanges are folded into operative position the corners 27 on flanges 17A, 17B engage beneath shoulders 25 on flanges 18A, 18B, and the side edges of tabs 24 engage in the notches 26, with the tabs 24 on flanges 18A, 18B lying beneath the adjacent edges of flanges 17A, 17B, interlocking the flanges together. It will be noted that the notches 26 and corners 27 in the present invention are rounded as distinguished from the rectilinear shape of these elements in U.S. Pat. No. 6,076,730, facilitating alignment and engagement of the interlocking portions of the flanges when they are being folded into their interlocking positions.

In the preferred embodiment shown in FIG. 2, substantially identical bottom flaps 30A and 30B are foldably joined to bottom edges of respective sidewall panels 12 and 14 along folds 31, and bottom flaps 32 and 33 are foldably joined to bottom edges of respective sidewall panels 13 and 15 along folds 34. In a container erected from the blank the flaps 30A and 30B comprise inner flaps and the flaps 32 and 33 comprise outer flaps.

The flaps 30A and 30B are rectangular in shape, and a line of perforations define a perf score 35 across each flap adjacent but spaced from the folds 31. When a container is erected from the blank, the flaps 30A, 30B are disposed in opposed relationship to one another and each flap extends most of the way across the bottom of the container, with the free end edge of each flap terminating just short of a respective perf score 35 in the opposed flap. This arrangement helps facilitate folding of the flaps into operative position as depicted in FIG. 6. The side edge of flap 30A is recessed slightly at 36A adjacent glue flap 22, and one side edge of flap 30B is recessed slightly at 36B adjacent its outer end edge. These recessed areas 36A, 36B provide clearance for the glue flap 22 when the flaps are folded into their operative positions in a container erected from the blank.

The side edges of flap 32 are cut away along curvilinear lines to define a narrowed locking tab 37 on the outer end edge thereof, and rounded shoulders 38 on opposite side edges.

The locking tab 37 and shoulders 38 cooperate with flap 33 as described hereinafter to lock the bottom flaps in operative position across the bottom of a container erected from the blank.

Bottom flap 33 is generally rectangular in shape and a pair of diagonal fold scores 40 and 41 extend from opposite corners of the flap closely adjacent the fold 34 to the outer end edge thereof in inwardly spaced relation to opposite side edges of the flap, defining triangularly shaped corners 42. A generally chevron shaped slot 43 is formed in approximately the middle of the flap 33 for receiving the locking tab 37 on flap 32 as described hereinafter.

In the preferred embodiment as shown in FIG. 2, a pair of reinforcing strands 45 of Sesame Tape or other reinforcing strand known in the art extends across the blank from one end edge to the other approximately midway between the top and bottom edges thereof. As indicated by the arrow "A" in FIG. 2, the corrugations of the outer component 21 extend perpendicular to the top and bottom edges of the blank, and the reinforcing strands extend perpendicular to the corrugations.

Figure 3:
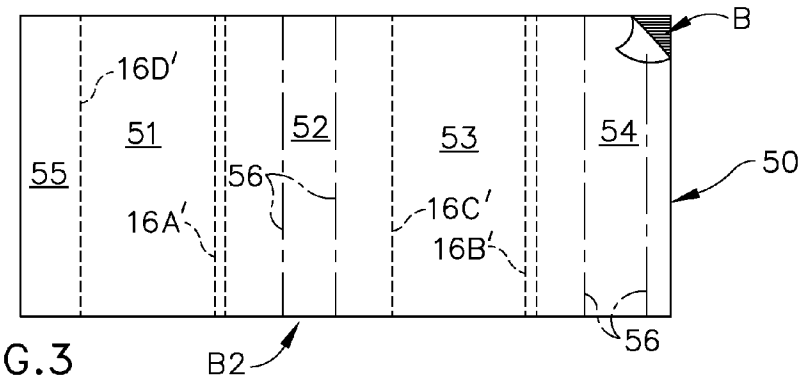
FIG. 3 is a top plan view of a blank for making the inner liner of the container of the invention.

A blank B2 for making the inner liner 50 of the container of the invention is shown in FIG. 3. The blank B2 is rectangular in shape and comprises four sidewall panels 51, 52, 53 and 54 joined together along respective scores 16A', 16B' and 16C', with a glue flap 55 foldably joined to one end edge of the blank along fold 16D' and which effectively joins panel 51 to panel 54 when the container is glued up. The scores 16A' and 16B' are double scores as more fully described and illustrated in applicant's prior U.S. Pat. No. 4,693,413, the disclosure of which is incorporated in full herein by reference. In a container erected from the blank, the scores 16A' and 16B' in the liner extend contiguous with the scores 16A and 16B in the outer component, and the scores 16C', 16D' extend contiguous with the scores 16C, 16D, respectively. The scores 16A', 16B', 16C' and 16D' in the liner are pre-broken with a jig (not shown) prior to lamination of the liner 50 to the outer component 21 to facilitate fabrication of the container and to make it easier for a user to open up a flattened container into its operative position. In the preferred embodiment as shown in FIG. 3, a first pair of reinforcing strands 56 of Sesame Tape or other reinforcing strands known in the art is applied to a midportion of sidewall panel 52, extending from the bottom edge thereof to the top edge, and at least one reinforcing strand 56 (two are shown in FIG. 3 and one in FIG. 5) is applied to a midportion of panel 54, extending from the bottom edge to the top edge of that panel. As indicated by the arrow "B", it will be noted that the corrugations in the liner extend in a direction perpendicular to the corrugations in the outer component. Thus, the reinforcing strands in the liner extend perpendicular to the corrugations in the liner, and as seen best in FIG. 5 they extend perpendicular to the reinforcing strands in the outer component in a container erected from the blank.

FIG. 5 shows the inner liner 50 laminated to the outer component 21 to form a laminated blank 57 from which the container is erected. It will be noted that the liner is shifted to the left as viewed in this figure, with the glue flap 55 on the liner projecting beyond the glue flap 22 on the outer component, and the opposite end of the liner inset relative to the adjacent end of the outer component, defining a space 58 for attachment of the glue flap 55.

To set up a container from its flattened condition to its expanded operative condition, it is opened into a tubular configuration and the partial top flaps are folded into their operative interlocked position as described previously herein. The container is then inverted so that it rests on its top end, and the bottom flaps are folded into their operative interlocked positions as depicted in FIG. 6. Flaps 30A and 30B are first folded inwardly into the container, followed by inward folding of flap 33 and then flap 32. The flaps are pressed downwardly into the container until the locking tab 37 engages in slot 43, and the flaps are then pulled outwardly into a generally flat position across the bottom of the container. It will be noted that the perf scores 35 in flaps 30A and 30B and the folds 40 and 41 in flap 33 enable these flaps to deform slightly during the folding operation to facilitate set up of the container.

Figure 4:
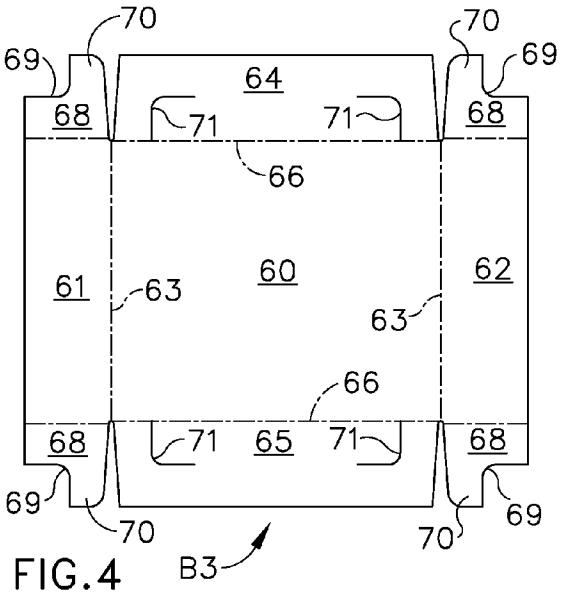
FIG. 4 is a top plan view of a blank for making a cap for use on the container of the invention.

A blank B3 for making the cap 20 is shown in FIG. 4. The blank comprises a rectangular center panel 60 with substantially identical end flaps 61 and 62 foldably joined to opposite end edges thereof along folds 63, and substantially identical side flaps 64 and 65 foldably joined to opposite side edges thereof along folds 66. As seen in FIG. 1, the flaps 61, 62 and 64, 65 interlock with one another to form a cap skirt 67. The interlocking construction of cap 20 is substantially the same as that for the liner tray 110 disclosed in U.S. Pat. No. 7,172,108. Thus, flaps 61 and 62 each has an assembly flap 68 on opposite side edges thereof, with an outer corner cut away at 69 to define a locking tab 70 that is inserted into angled slit cuts 71 in the flaps 64 and 65 adjacent opposite ends thereof.

Figure 7:
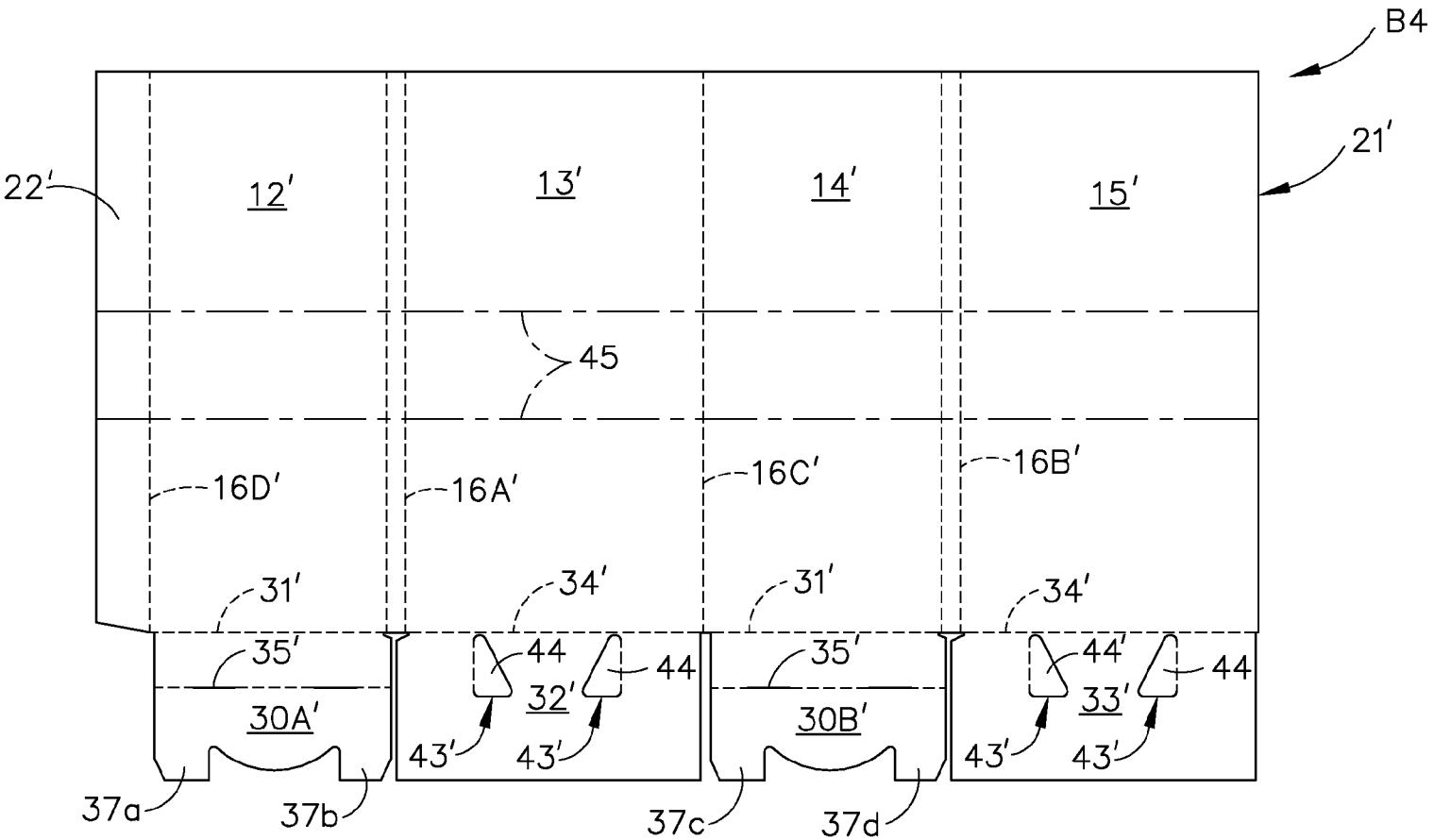
FIG. 7 is a top plan view of a blank for making the outer component of an alternative container according to the second embodiment of the invention.

FIG. 7 is a top plan view of an alternative blank B4 for making the outer component of an alternative container 10' according to the second embodiment of the invention. The blank B4 comprises four sidewall panels 12', 13', 14' and 15' joined together along the respective scores 16A', 16B' and 16C', with a glue flap 22' foldably joined to one end edge of the blank B4 along the score 16D' which effectively joins panel 12' to panel 15' when the container 10' is constructed. The scores 16A' and 16B' are double scores as more fully described hereinafter and illustrated in applicant's prior U.S. Pat. No. 4,693,413, the disclosure of which is incorporated in full herein by reference. As described in that patent, the scores 16A' and 16B' extend along those corners joining sidewall panels that move through 180 degrees between the unfolded position of the blank B4 and the folded flat position of a container made from the blank.

In the second embodiment shown in FIG. 7, substantially identical bottom flaps 30A' and 30B' are foldably joined to bottom edges of respective sidewall panels 12' and 14' along folds 31', and bottom flaps 32' and 33' are foldably joined to bottom edges of respective sidewall panels 13' and 15' along folds 34'. In a container erected from the blank B4 the flaps 30A' and 30B' comprise outer flaps and the flaps 32' and 33' comprise inner flaps. The bottom flap 30A' and 30B' can be defined as a first pair of flaps and the bottom flaps 32' and 33' can be defined as a second pair of flaps.

Each of the flaps 32' and 33' is generally rectangular in shape, and having a pair of triangularly shaped slots 43' formed spaced apart from one another and positioned approximately the middle of the respective flaps 32' and 33' near the folds 34' for receiving the locking tab 37A, 37B, 37C, and 37D on respective flaps 30A' and 30B'. The triangularly shaped slots 43' are mirror image of one another. Each of the triangularly shaped slots 43 includes a hinge flap 44 which helps the corresponding locking tabs 37A, 37B, 37C, and 37D to securely remain in the locking positions. When the container 10' is erected from the blank B4, the flaps 32' and 33' are disposed in opposed relationship to one another and each flap extends to the mid portion on the bottom of the container in a partial overlapping relationship with one another. This arrangement helps facilitate folding of the flaps into operative position as depicted in FIG. 6.

Each of the flaps 30A' and 30B' having cut away in the midsection of their respective free edge forming curvilinear line to define a respective pair of narrowed locking tabs 37A, 37B and 37C, 37D that resemble a generally respective U-shaped free edges. The respective locking tabs 37A, 37B and 37C, 37D are tapered at its corners to increase the ease of entry and push the respective hinge flaps 44 open for entry to the slots 43'. The midsection curvilinear lines provides linear tension riding against the opposing flaps' overlap and prevent the locking tabs from disengaging from the locking positions. The configurations and geometries demonstrated in the flaps 30A' and 30B' and flaps 32' and 33' provide the benefit of a very static locking mechanism when filled with product, but dynamic in its ability to be disengaged with minimal effort by a user. This enhancement is one of the advantages to an end user because it reduces required flap length, and increases in ease of constructing the blank B4. The locking tabs 37A, 37B are formed on opposed end of the flap 30A' and they are mirror image of one another. Similarly, the locking tabs 37C, 37D are formed on opposed end of the flap 30B' and they are mirror image of one another. The respective locking tabs 37A, 37B and 37C, 37D cooperate with respective flaps 32' and 33' as described hereinafter to lock the bottom flaps in operative position across the bottom of a container 10' erected from the blank B4. A line of perforations define a perf score 35' across each flaps 30A' and 30B' adjacent but spaced from the folds 31'.

Similar to the first embodiment as shown in FIG. 2, a pair of reinforcing strands 45' of Sesame Tape or other reinforcing strand known in the art extends across the blank B4 from one end edge to the other approximately midway between the top and bottom edges thereof. As indicated by the arrow "A" in FIG. 2, the corrugations of the outer component 21' extend perpendicular to the top and bottom edges of the blank B4, and the reinforcing strands extend perpendicular to the corrugations.

Figure 8:
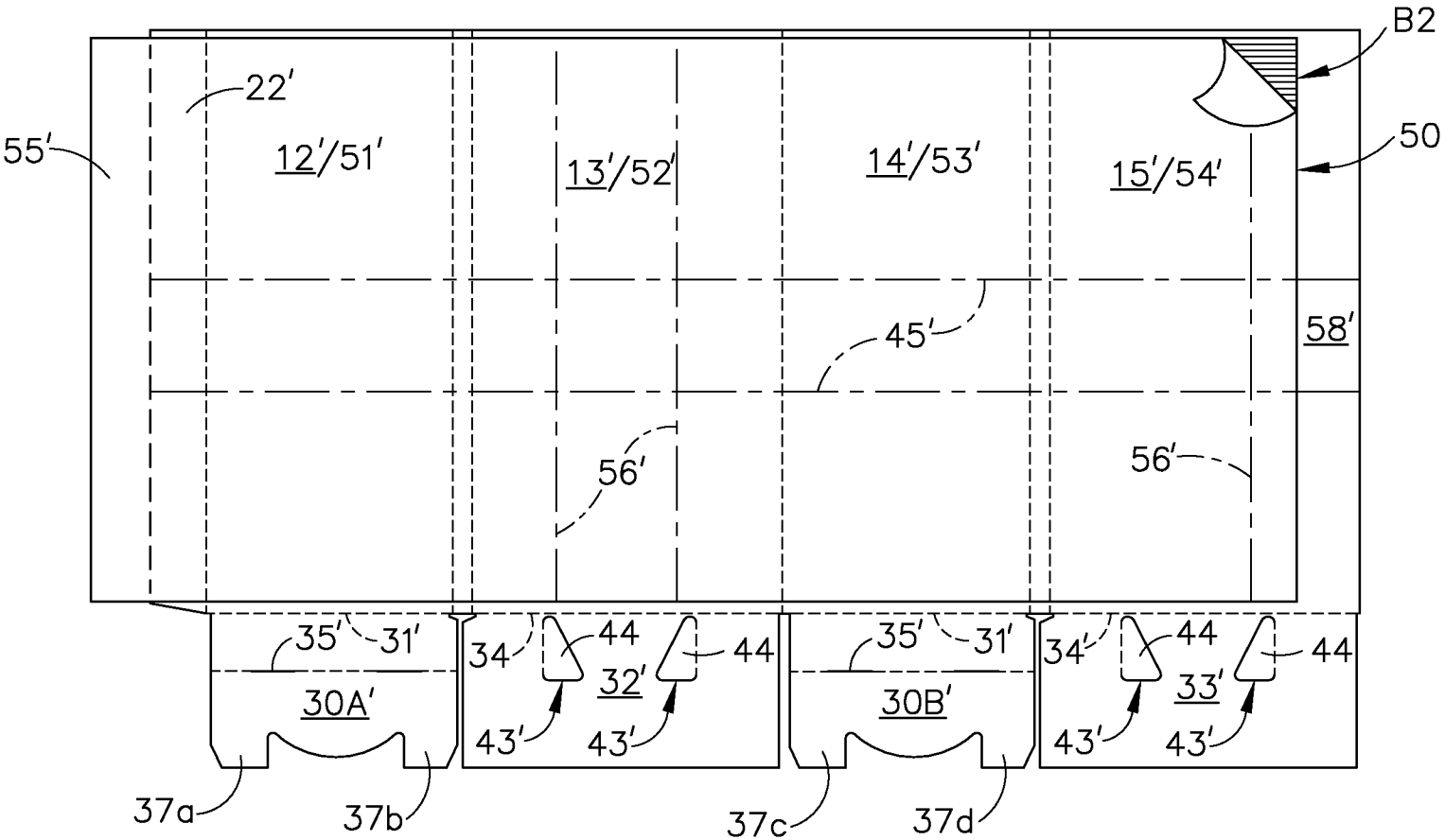
FIG. 8 is a top plan view showing the inner liner laminated to the outer component preparatory to folding the container and gluing the glue flaps together according to the second embodiment of the invention.

FIG. 8 is a top plan view showing the inner liner 50 in FIG. 3 laminated to the outer component 21' to form a laminated blank 57' from which the container 10' is erected according to the second embodiment of the invention. It will be noted that the liner 50 is shifted to the left as viewed in FIG. 8, with the glue flap 55' on the liner projecting beyond the glue flap 22 on the outer component 21', and the opposite end of the liner inset relative to the adjacent end of the outer component, defining a space 58' for attachment of the glue flap 55'. The Construction of the blank B4 including the inner liner 50 laminated thereto to form the container 10' will be described hereinafter.

Figure 9:
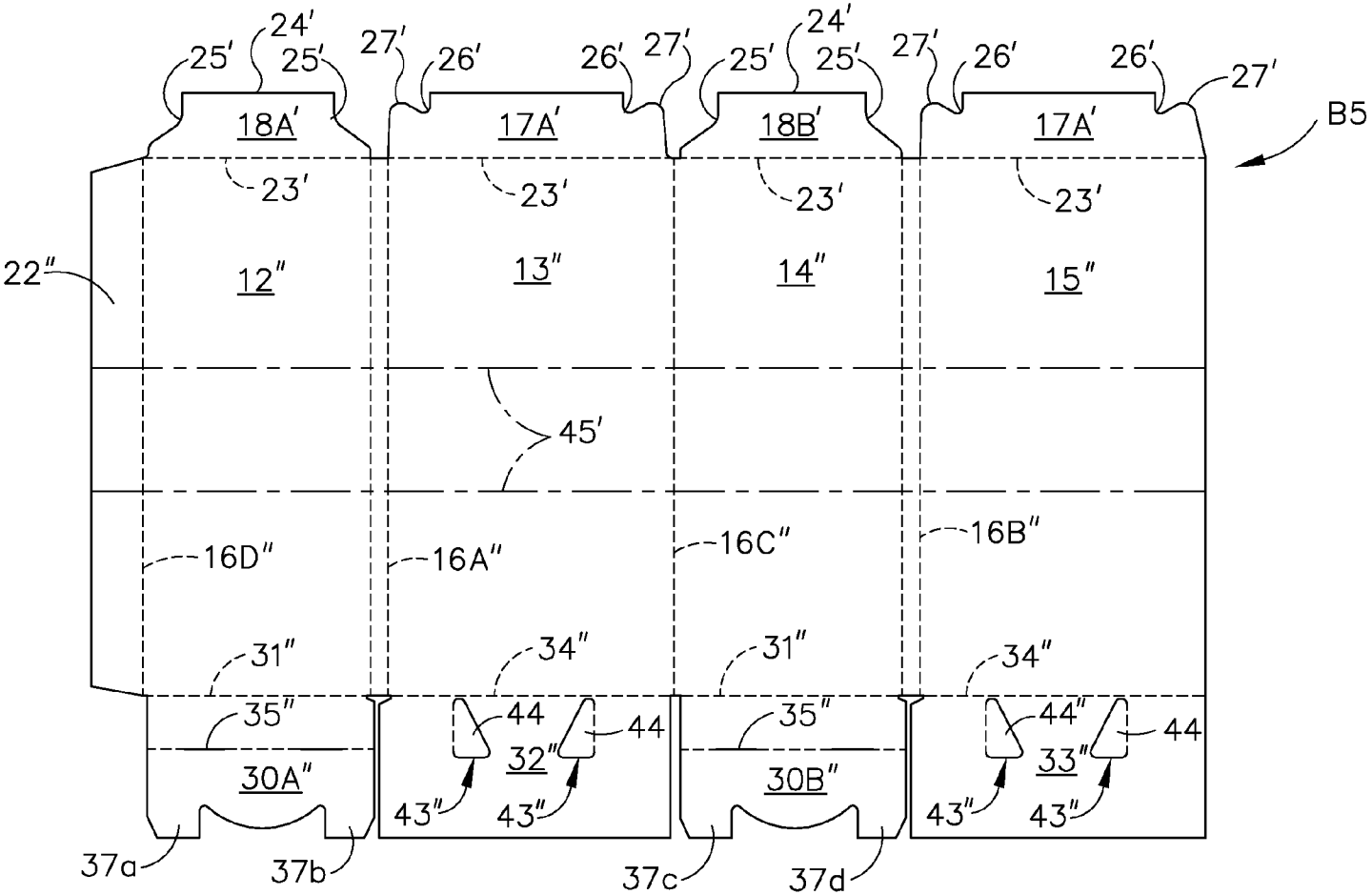
FIG. 9 is a top plan view of a blank for making the outer component of one further alternative container according to the third embodiment of the invention.

FIG. 9 is a top plan view of a blank B5 for making the outer component 21" of further alternative container according to the third embodiment of the invention. The blank B5 is exactly the same as the blank B4 except that the partial top flanges 17A, 17B and 18A, 18B, in the first embodiment, are foldably joined to top edges of the respective sidewall panels 13, 15, 12 and 14 along fold lines 23. Since the partial top flanges 17A, 17B and 18A, 18B are described in detail hereinabove with respect to the first embodiment of the invention, then the partial top flaps is not described to avoid redundancy.

Figure 10:
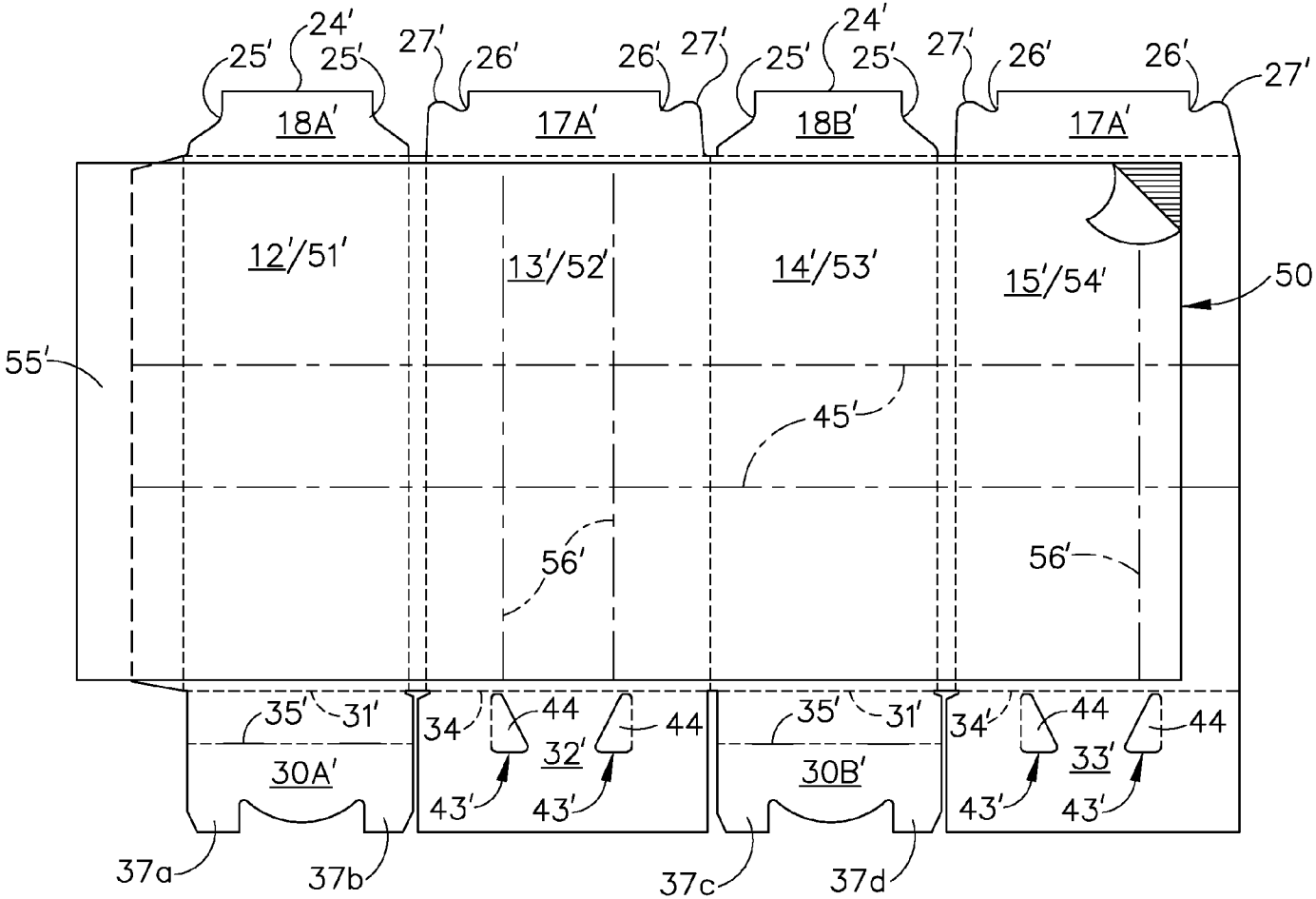
FIG. 10 is a top plan view showing the inner liner laminated to the outer component preparatory to folding the container and gluing the glue flaps together according to the third embodiment of the invention.

FIG. 10 is a top plan view showing the inner liner 50 in FIG. 3 laminated to the outer component 21" preparatory to form a laminated blank 57" from which the container 10" is erected according to the third embodiment of the invention. It will be noted that the liner 50 is shifted to the left as viewed in FIG. 10, with the glue flap 55" on the liner projecting beyond the glue flap 22" on the outer component 21", and the opposite end of the liner inset relative to the adjacent end of the outer component, defining a space 58" for attachment of the glue flap 55". The Construction of the blank B5 including the inner liner 50 laminated thereto to form the container 10" will be described hereinafter.

Figure 11:
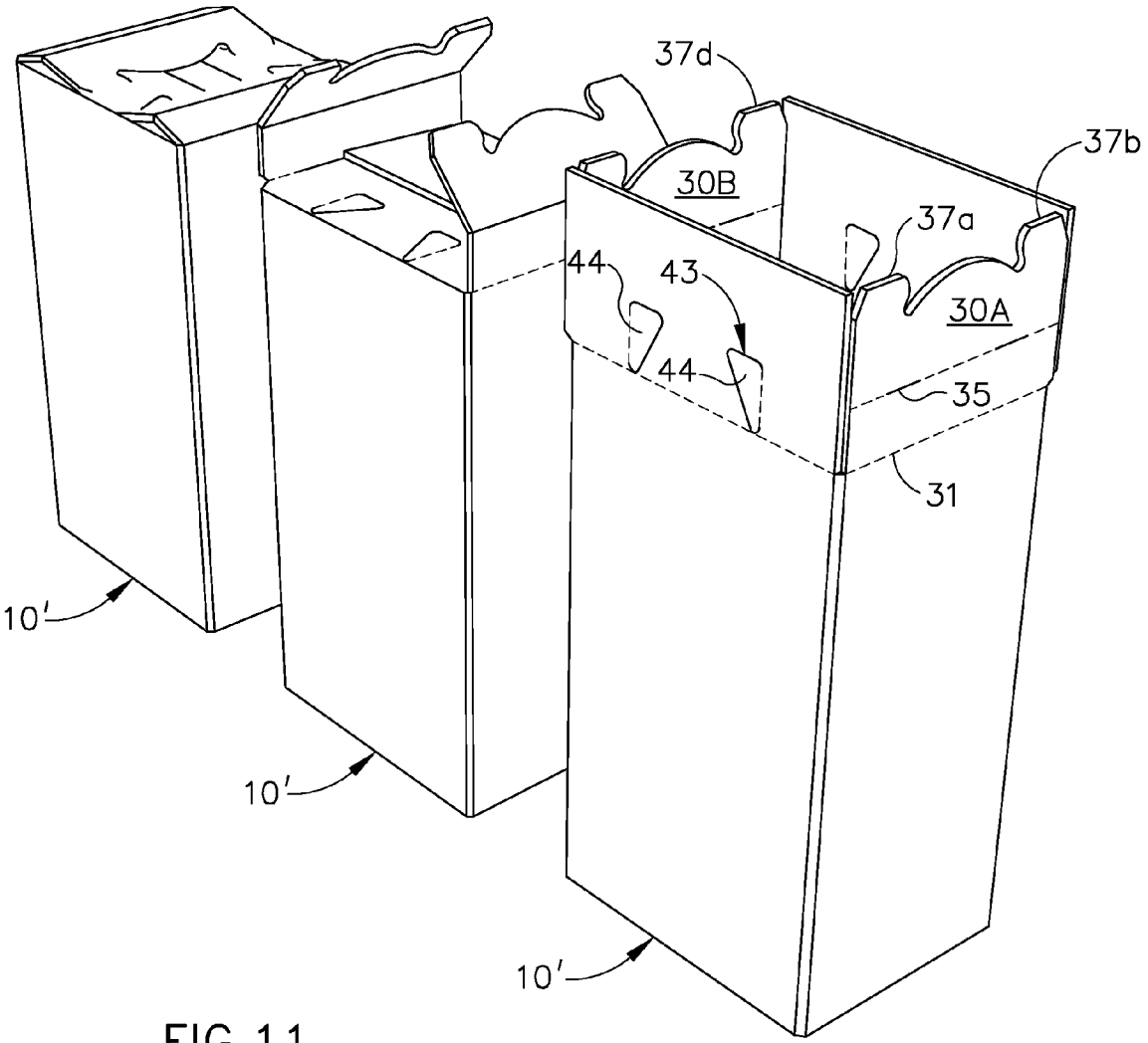
FIG. 11 shows the container in an inverted position and depicts the series of steps performed in folding the interlocking bottom flaps into operative interlocked position according to the second embodiment of the invention.
Figure 12:
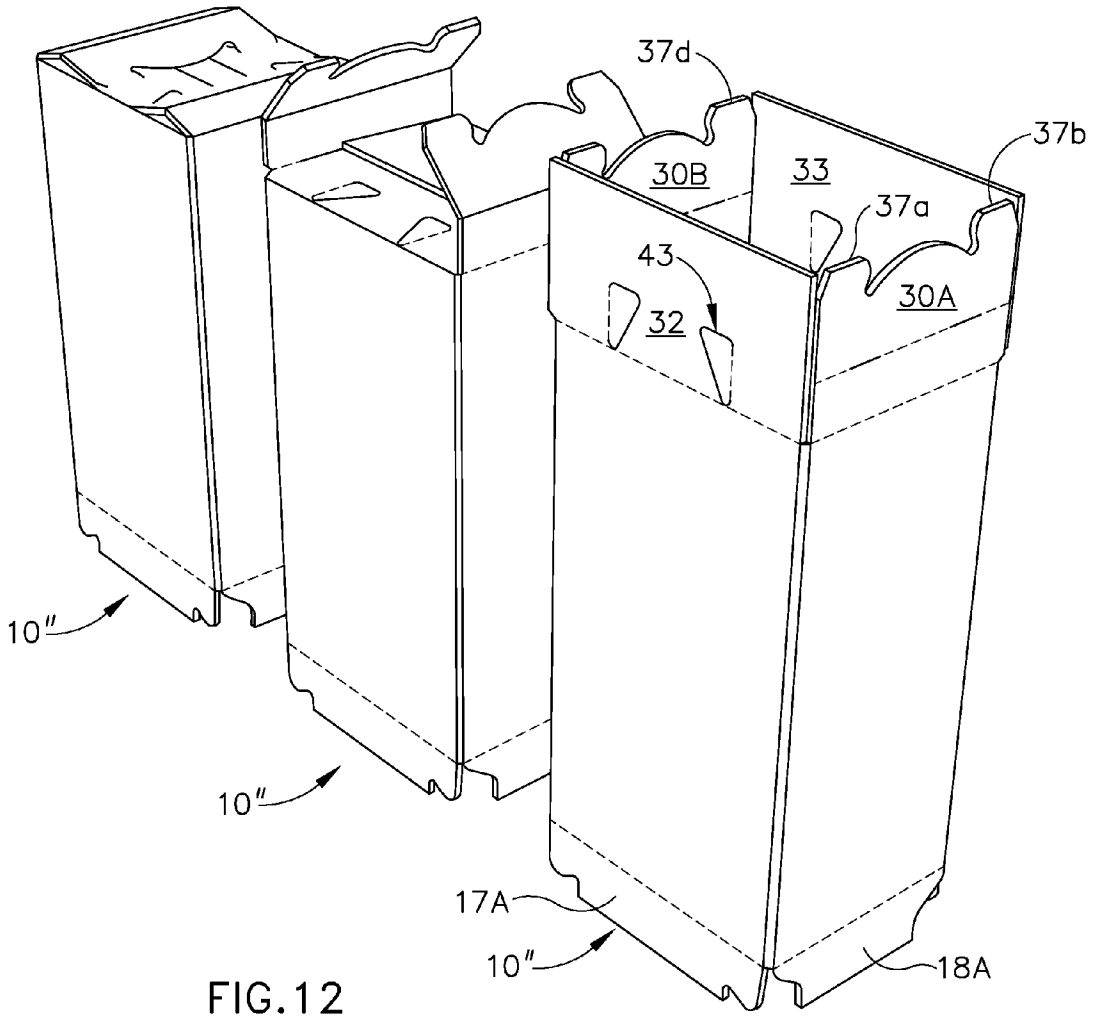
FIG. 12 shows the container in an inverted position and depicts the series of steps performed in folding the interlocking bottom flaps into operative interlocked position according to the third embodiment of the invention.
Figure 13:
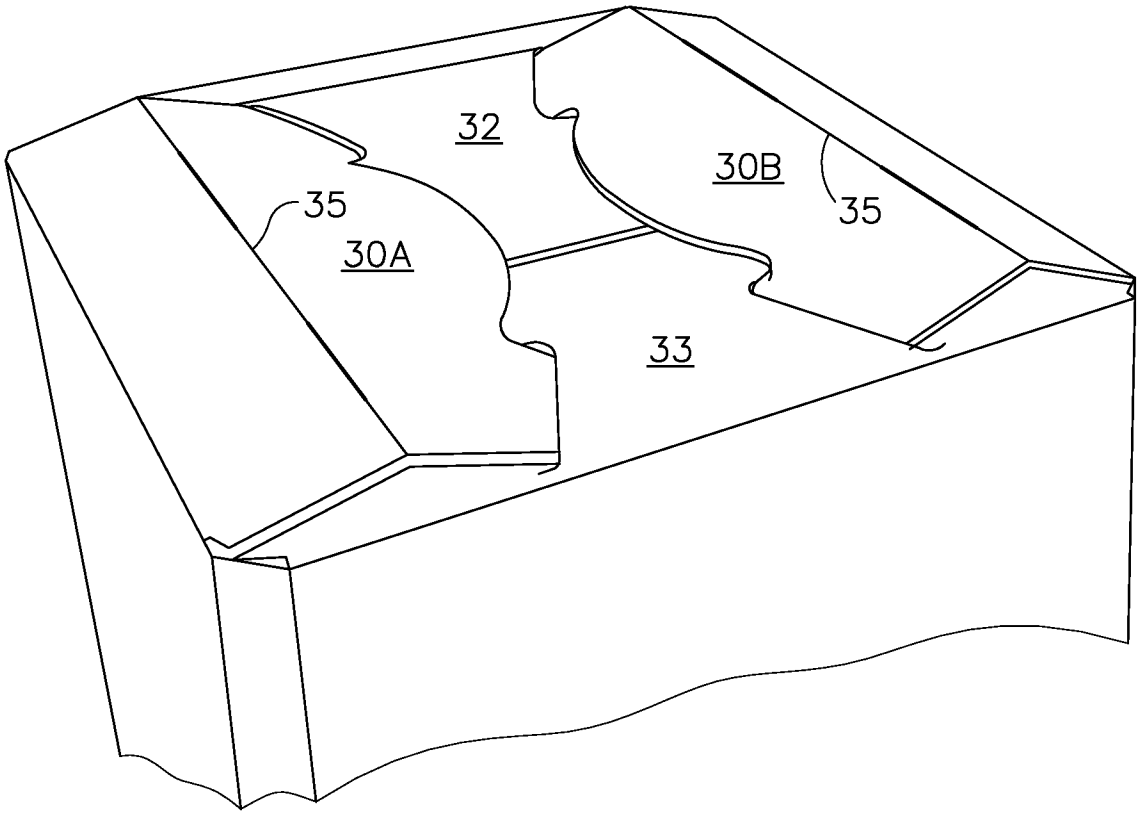
FIG. 13 is an enlarged view of the bottom portion of the containers depicted in FIGS. 11 and 12 illustrating the manner in which the interlocking bottom flaps engaged into operative interlocked position.

To set up a container 10' and 10" from its flattened condition to its expanded operative condition, it is opened into a tubular configuration and the partial top flaps are folded into their operative interlocked position as described previously herein. The container is then inverted so that it rests on its top end, and the bottom flaps are folded into their operative interlocked positions as depicted in FIG. 11. Flaps 32' and 33' are first folded inwardly into the container in an overlapping relationship, followed by inward folding of flaps 30A' and 30B'. The flaps 30A' and 30B' are pressed downwardly into the container until the locking tabs 37A, 37B and 37C, 37D engages in respective slots 43' as illustrated in FIG. 13. It will be noted that the perf scores 35' in flaps 30A and 30B enable these flaps to deform slightly during the folding operation to facilitate set up of the container as illustrated in FIG. 13. The respective locking tabs 37A, 37B and 37C, 37D are tapered at its corners to increase the ease of entry and push the respective hinge flaps 44 open for entry to the slots 43'. The midsection curvilinear lines provides linear tension riding against the opposing flaps' overlap and prevent the locking tabs 37A, 37B and 37C, 37D from disengaging from the locking positions. The configurations and geometries demonstrated in the flaps 30A' and 30B' and flaps 32' and 33' provide the benefit of a very static locking mechanism when filled with product, but dynamic in its ability to be disengaged with minimal effort by a user. This enhancement is one of the advantages to an end user because it reduces required flap length, and increases in ease of constructing the blank B4.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A reinforced cross laminated bulk container made of corrugated paperboard and having a rectangular configuration, the container comprising:

an outer corrugated component having opposed sidewalls joined together along vertical scores at corners of the container, the sidewalls having top, bottom and side edges, and the outer component having corrugations running in a first direction, the bottom edges of the sidewalls include a first pair of flaps and a second pair of flaps each of which foldably extend outwardly therefrom and wherein each of the second pair of flaps having a pair of spaced apart triangularly shaped slots formed therein;

an inner corrugated liner laminated to the outer component and having opposed sidewalls joined together along vertical scores at corners of the container, the sidewalls having top, bottom and side edges substantially coterminous with the top, bottom and side edges of the respective sidewalls of the outer component, and the inner liner having corrugations running in a second direction perpendicular to the first direction; and the outer component and the inner liner each having at least one reinforcing strand therein extending perpendicular to the corrugations thereof, wherein the at least one reinforcing strand in the liner extends perpendicular to and crosses the at least one reinforcing strand in the outer component.

2. The container of claim 1, wherein each of the first pair of flaps includes a pair of locking tabs formed on opposed end of the respective first pair of flaps which are engaged with the slots on the second pair of the flaps to securely close the bottom of the container.

3. The container as claimed in claim 1, wherein:

top flanges are foldably joined to the top edges of said outer component to at least partially close the top of said container.

4. A container as claimed in claim 1, wherein:

the corrugations of said outer component extend vertically and the corrugations of said inner liner extend horizontally;

said at least one reinforcing strand in said outer component extends horizontally substantially midway between the top and bottom edges thereof; and said at least one reinforcing strand in said inner liner comprises at least one reinforcing strand extending vertically in each said sidewall substantially midway between opposite side edges thereof.

5. A blank of corrugated paperboard for making a reinforced bulk container, comprising:

an outer component having a plurality of sidewall panels and end wall panels foldably joined together along spaced parallel scores, said plurality of sidewall panels and end wall panels having top and bottom edges;

said outer component having corrugations extending perpendicular to said top and bottom edges;

at least one reinforcing strand extending across said outer component perpendicular to said corrugations and approximately midway between said top and bottom edges;

an inner liner having a plurality of sidewall panels and end wall panels foldably joined together along spaced parallel scores is laminated to said outer component, said plurality of sidewall panels and end wall panels of said liner having top and bottom edges and wherein at least some of said spaced parallel scores in said inner liner are pre-broken prior to lamination of said inner liner to said outer component;

said inner liner having corrugations extending parallel to said top and bottom edges thereof;

at least one reinforcing strand extending across at least one of said plurality of sidewall panels perpendicular to said corrugations and approximately midway between opposite side edges of said at least one of said plurality of sidewall panels.

top flanges are foldably joined to said top edges of said plurality of sidewall panels and end wall panels, said top flanges having interlocking structure for locking them together in a container erected from said blank; and bottom flanges are foldably joined to said bottom edges of said plurality of sidewall panels and end wall panels, said bottom flanges having interlocking structure for locking them together in a container erected from said blank.

* * * * *